US008557759B2

(12) United States Patent
Jernigan

(10) Patent No.: US 8,557,759 B2
(45) Date of Patent: Oct. 15, 2013

(54) HVAC-R FLUSHING SOLVENT

(75) Inventor: Anthony Edward Jernigan, Chattahoochee, FL (US)

(73) Assignee: Diversitech Corporation, Duluth, GA (US)

( * ) Notice: Subject to any disclaimer, the term of this patent is extended or adjusted under 35 U.S.C. 154(b) by 138 days.

(21) Appl. No.: 13/312,175

(22) Filed: Dec. 6, 2011

(65) Prior Publication Data

US 2012/0145199 A1 Jun. 14, 2012

Related U.S. Application Data

(60) Provisional application No. 61/422,841, filed on Dec. 14, 2010.

(51) Int. Cl.
*C11D 7/50* (2006.01)

(52) U.S. Cl.
CPC ..... *C11D 7/5063* (2013.01)
USPC ..... 510/407; 510/412

(58) Field of Classification Search
USPC ..... 510/407, 412
See application file for complete search history.

(56) References Cited

U.S. PATENT DOCUMENTS

2004/0224870 A1* 11/2004 Doyel et al. ..... 510/412

* cited by examiner

*Primary Examiner* — Gregory Webb
(74) *Attorney, Agent, or Firm* — Smith, Gambrell & Russell, LLP

(57) ABSTRACT

A flushing solvent for flushing an HVAC-R system is a mixture of hydrofluoroether, acetone, t-Butyl acetate, and trans 1,2 Dichloroethylene.

10 Claims, 2 Drawing Sheets

HVAC-R FLUSHING SOLVENT

FIELD OF THE INVENTION

This invention relates to a flushing solvent and more particularly to a Heating, Ventilating, Air Conditioning and Heating (HVAC-R) flushing solvent with low toxicity, low emissions of volatile organic compounds (VOCs), low global warming potential, improved varnish cutting capability, and improved water absorption.

BACKGROUND OF THE INVENTION

HVAC-R system flushing solvents are used to remove old refrigerant and other contaminants from refrigeration compressor systems, including HVAC-R systems. The need to remove old refrigerant and other contaminants from the HVAC-R systems results from two primary circumstances, refrigerant retrofit and compressor burnout. Before an HVAC-R system can be retrofit by charging the HVAC-R system with a new, environmentally friendly refrigerant, the old refrigerant and any other contaminants in the HVAC-R system must be removed. Where a compressor burnout event has occurred, the old refrigerant and contaminants in the HVAC-R system must be removed before the compressor system can be recharged with fresh refrigerant.

SUMMARY OF THE INVENTION

In accordance with the present invention, an HVAC-R flushing solvent is formulated to have low toxicity, low emissions of volatile organic compounds (VOCs), low global warming potential, improved varnish cutting capability, and improved water absorption. The HVAC-R flushing solvent includes hydrofluoroether, acetone, t-butyl acetate and trans 1,2 dichloroethylene. The relative amounts accomplish degreasing and varnish penetration. These relative amounts include 1-40% hydrofluoroether, 1-40% acetone, 1-40% t-butyl acetate and 20-70% trans 1,2 dichloroethylene. The flushing solvent can be packaged in a kit form to facilitate handling, treatment consistency, and ease of use. The kit would include the flushing solvent of the invention in a container along with one or more of a charging hose, clip-on funnel, and injector trigger nozzle. A reusable tank can also be included, if desired. The method of using the flushing solvent includes the steps of introducing the solvent into the inlet of the device to be treated, purging the solvent, and monitoring the solvent exiting the outlet for the presence of contaminants, which is evident as color. The steps can be repeated until the exiting solvent is color-free, an indication that the contaminants have been removed. The contaminants are those associated with compressor burnout or in the case of replacing refrigerants the contaminants associated with oil residuals.

DETAILED DESCRIPTION OF THE INVENTION

Figure 1:
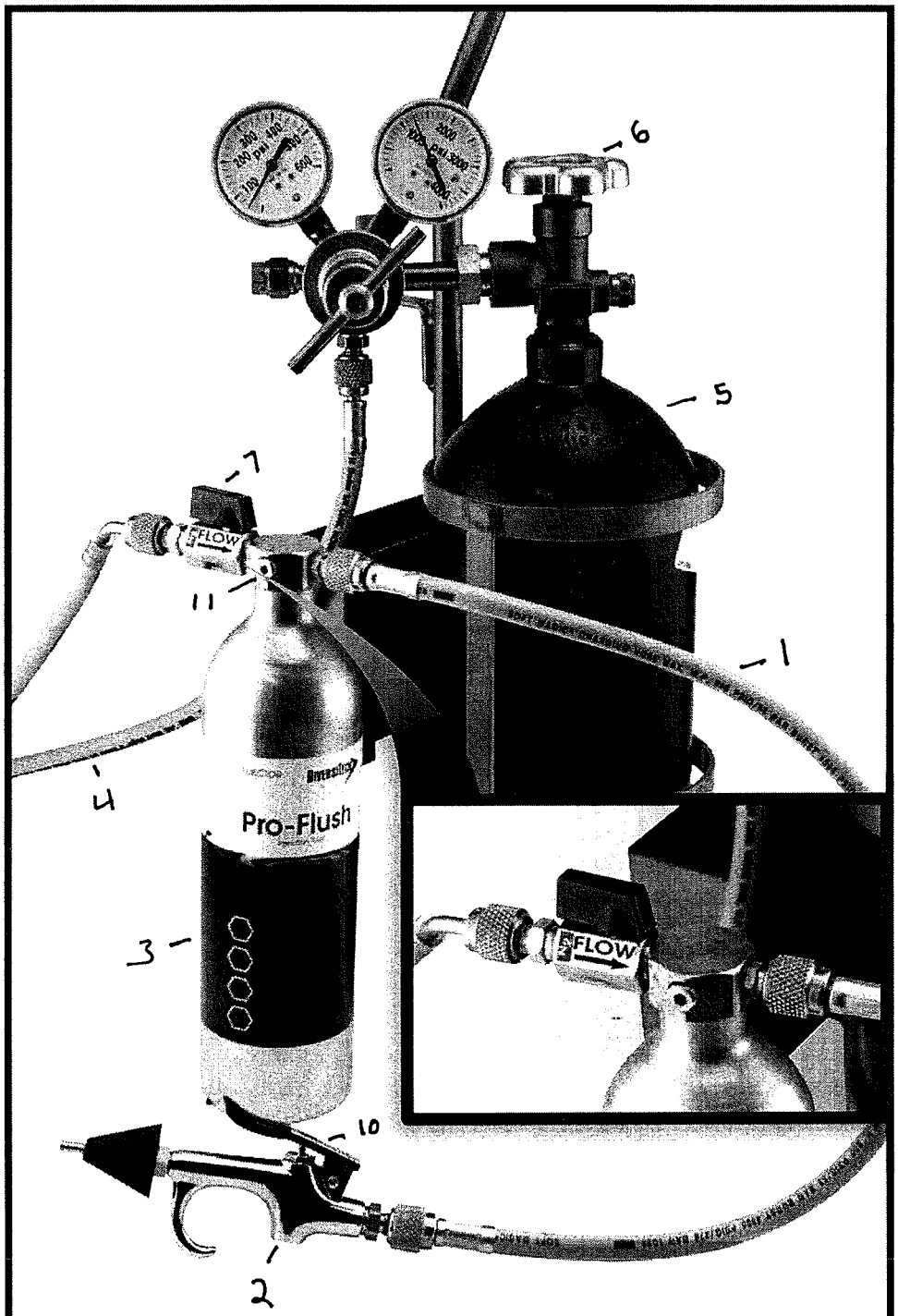
FIG. 1 is a photograph showing the components of a typical kit, e.g. a Pro-Flush kit. The kit, in particular, includes connection hoses (1, 4), a reusable injection tank (3), and injection tool assembly (2) with a trigger injector (10). A container of the flush solvent is included but not shown.

A suitable HVAC-R flushing solvent is formulated as follows:

TABLE 1

| Material | Percentage by weight | Function |
|---|---|---|
| Hydrofluoroether | 1-40% | co-solvent and flame suppressant |
| Acetone | 1-40% | co-solvent, water scavenger, and varnish penetrant |
| t-Butyl acetate | 1-40% | co-solvent, water scavenger, and varnish penetrant |
| trans 1,2 Dichloroethylene | 20-70% | primary degreaser and co-solvent |

A preferred formulation of the HVAC-R flushing solvent is as follows:

TABLE 2

| Material | Percentage by weight | Function |
|---|---|---|
| Hydrofluoroether | 18% | co-solvent and flame suppressant |
| Acetone | 10% | co-solvent, water scavenger, and varnish penetrant |
| t-Butyl acetate | 22% | co-solvent, water scavenger, and varnish penetrant |
| trans 1,2 Dichloroethylene | 50% | primary degreaser and co-solvent |

A more preferred formulation of HVAC-R flushing solvent is as follows:

TABLE 3

| Ingredient | CAS No. | EIN/ECS No. | % |
|---|---|---|---|
| Acetone | 67-64-1 | 200-662-2 | 10-20 |
| t-Butyl Acetate | 540-88-5 | 208-760-7 | 20-30 |
| Trans 1,2 Dichloroethylene | 156-60-5 | 205-860-2 | 50-60 |
| Ethyl Nonafluoroisobutyl Ether | 163702-06-5 | 98-02-0209-00 | 10-20 |
| Ethyl Nonafluorobutyl Ether | 163702-05-4 | 98-02-0209-00 | 10-20 |

The hydrofluoroether (HFE) is ethoxy-nonafluorobutane ($C_4F_9OC_2H_5$), a clear, colorless, and low-odor fluid. A suitable HFE material is manufactured and sold by the 3M Company of St. Paul, Minn. under the brand name Novec 7200. A complete product description for the Novec 7200 HFE material appears in the 3M Novec 7200 Engineered Fluid brochure and the Material Safety Data Sheet for the Novec 7200 HFE material. Both are available from 3M. The contents of each are incorporate herein by reference.

Using the combination of acetone and t-butyl acetate with the trans 1,2 dichloroethylene in the hydrofluoroether (HFE) blend gives the resulting flushing solvent of the present invention superior water absorption and varnish cutting properties while remaining VOC-exempt. Varnish cutting properties for the flushing solvent are important in the circumstance of a compressor burnout where varnish residues and oil sludge are present in the compressor system. The unique combination of the flushing solvent of the present invention also gives the flushing solvent enhanced oil miscibility compared to conventional hydrofluorocarbon (HFC) based flushing solvents.

With respect to the properties of the flushing solvent specified in Tables 1, 2 and 3 above, the flushing solvent exhibits no flash point up to the boiling point of approximately 106° F. Consequently, the flushing solvent of the present invention is generally less volatile than HFC based flushing solvents.

Because the Novec 7200 HFE material is a segregated molecule that contains oxygen and results in a significant reduction in the fluorine content versus HFC based flushing solvents, the flushing solvent in accordance with the present invention is inherently less toxic than HFC based flushing solvents on that basis alone. In fact, the flushing solvent is practically non-toxic through inhalation. The flushing solvent has a toxicity rating of LC 50 rat:92,000 ppm. LC stands for lethal concentration. The case of the flushing solvent of the present invention, LC value refers to the concentration of vapors of the flushing solvent in air. For inhalation experiments, the concentration of the chemical in air that kills 50% of the test animals [rats] in a given time (usually four hours) is the LC 50 value. The exposure ceiling for maximum airborne concentration based on a time weighted average for an eight hour day is 200 ppm for the flushing solvent of the present invention.

With respect to environmental properties, the flushing solvent of the present invention has a global warming potential (GWP) of 55 compared to HFC based flushing solvents which have GWP values in the range of 1000. Moreover, the flushing solvent of the present invention has an atmospheric lifetime of 0.77 years compared to the atmospheric lifetimes of 7-17 years for HFC based flushing solvents. Further, the formulation of the present invention has no ozone depletion potential (ODP).

The method of using the flushing solvent to clean or flush the compressor system of interest generally involves the following steps: introducing the solvent of the invention, e.g. Pro-Flush™, at an inlet, purging the solvent and monitoring the solvent exiting the outlet for the presence of contaminants, and repeating the process if contamination (color) is present. The absence of the contaminant is evidenced by a colorless/clear liquid. The solvent can be introduced incrementally. The contaminants which are removed include oils and substances associated with compressor burnout. The steps can be repeated until the exiting solvent is colorless.

The detailed steps associated with the removal of substances associated with compressor burnout include: a) evacuate the system using approved techniques and recovery equipment; b) take the electrical system off-line; c) remove the old compressor from the system; d) remove filter drier cores as well as any check valves and reversing valves on heat pumps (It may be faster and less expensive to by-pass the filter drier, check and reversing valves with a by-pass loop.); e) make sure a re-sealable waste container is attached to a discharge port to capture the flushed acidic contaminants; f) to maximize solvent contact time, restrict the flow at the discharge port. (This will minimize the amount of solvent needed to thoroughly clean the system.); g) attach the hose (1) and injector tool assembly (2) to the outlet side of the pressure tank (3) and fill the flushing solvent, e.g. Pro-Flush™, by connecting the hose (4) from the regulator of the nitrogen tank (5) to the inlet (ball valve) side of the injector tank (3) (FIG. 1); h) set the nitrogen gauge at 50 psi, open the regulator valve (6) on the nitrogen tank (5) then slowly open the valve (7) on the injector tank to pressurize it; i) close the valve on the injector tank and nitrogen tank and then disconnect the nitrogen hose from the injection tank (3); j) insert the rubber adapter (8) in the inlet port (9) (FIG. 2), maintaining the injector tank (3) in an upright position and inject the flushing solvent, e.g. Pro-Flush™ Solvent, in 3 second increments in stages (2-3 oz/ton) (The number of flushes will depend on the size of the system and the contamination level.); k) connect the hose from the nitrogen tank (5) to the inlet port (9) of the part that is being flushed and purge the system at 150 psi for 1-2 minutes (This will assure removal of all trace amounts of oil residue and solvents.); l) check the solvent at the outlet port to be sure all contaminants have been purged from the system; (If the exiting solvent is not yet colorless repeat steps j and k.) Next install the new compressor, new filter drier core and check valves. If the system was bypassed with a loop, remove and reconnect the lines. Using a vacuum pump, evacuate the system to a low micron reading. The typical evacuation time is approximately 3 minutes per ton. Check the system for leaks, and then recharge the system with refrigerant and oil per the equipment manufacturer's recommendations. Reconnect the electrical circuitry and test the system again following manufacturer recommendations. Any unused flushing solvent, e.g. Pro-Flush™ Solvent, can be stored in the injection tank and saved for future use. Ensure all valves are closed on the injection tank to prevent solvent loss during storage. The disposal of the waste solvent should be in accordance with local and state waste regulations.

The detailed steps associated with the removal of substances, such as oils and other like-residues prior to refrigerant conversions, e.g. R-22 to R-410A Conversions, include a) disconnect and remove old equipment; b) make sure a resealable waste container is attached to the exit end of the line set to capture the flushed oil (Establish one end of the line set as the discharge point.); c) to maximize solvent contact time, restrict the flow at the discharge point (This will also minimize the amount of solvent needed to thoroughly clean the system. For best results, use a DiversiTech Line Set Flush Adapter to connect the liquid line and the suction line at the disconnected air handler.) and inject solvent into the liquid line and collect solvent at the suction line outdoors at the disconnected condensing unit; d) attach the hose (1) and injector tool assembly (2) to the outlet side of the pressure tank (3) and fill the injector pressure tank (3) with flushing solvent, e.g. Pro-Flush™ Solvent, (A tank may be filled with up to 24 oz. of Pro-Flush™.) and connect the hose (4) from the regulator of the nitrogen tank to the inlet (ball valve) side of the injector tank (3) (FIG. 1); e) set the pressure regulator on the nitrogen tank (5) at 50 psi, open the inlet valve (6) at the tank then slowly open the valve (7) on the injector tank (3) to pressurize it; f) after pressurizing the injection tank, close both valves and disconnect the nitrogen fill hose (4) (Line sets of different diameters, lengths and configurations will require different quantities of flushing solvent, e.g. Pro-Flush™ solvent, to achieve complete removal of residual oils. For liquid lines, a 16 oz. can of Pro-Flush™ will typically clean up to 500 ft. of liquid line.); g) insert the rubber adapter (8) in the inlet (9) of one of the line sets, maintaining the injector tank (3) in an upright position, and inject the flushing solvent, e.g. Pro-Flush™ solvent, in 3 second increments in stages (The number of flushes will depend on the length of the line and the contamination level. A typical line set will require 2 to 3 oz of Pro-Flush™ to effectively remove the oil residual in the line sets. Results will vary depending on contamination level. For larger diameter tubing: Larger diameter line sets will require considerably more Pro-Flush™ solvent due to increased volume of the larger tubing. The flushing process will therefore require multiple 3 second injections of Pro-Flush™ solvent to achieve satisfactory results.); h) connect the hose (4) from the nitrogen tank (5) to the inlet port (9) (FIG. 2) of the part that is being flushed and purge the system at 150 psi for 1-2 minutes (This will assure removal of all trace amounts of oil residue and solvents.); i) check the solvent at the outlet port to be sure all contaminants have been purged from the system and if the exiting solvent is not yet colorless, repeat steps g and h. Connect the new equipment. Using a vacuum pump, evacuate the system to a low micron level. Connect the electrical circuitry and test the system again following manufacturer recommendations. Any unused flushing solvent, e.g. Pro-Flush™ solvent, can be stored in the injection tank (3) and saved for future use. Ensure all valves are closed on the injection tank to prevent solvent loss during storage. Dispose of the waste solvent in accordance with local and state waste disposal regulations.

Kits may be employed to facilitate handling, promote treatment consistency and ease of use. A kit, e.g. the Pro-Flush™ kit (shown in FIG. 1), contains a reusable injection tank (3) (with built-in 200 psi pressure relief valve (11)), one or more hoses (1, 4), injection tool assembly (2) and one 16 oz. can of flushing solvent (not shown), e.g. Pro-Flush™ Solvent. (FIG. 2 shows the rubber adaptor (8), which can be included in the kit. A trigger injector (10), also shown in FIG. 2, on the tool assembly assures more efficient use of the solvent by allowing infinite control of the flushes rather than the less efficient method of flushing in one long burst.) The flush solvent, e.g. Pro-Flush™ Solvent, is a dual purpose blend designed to clean line sets in preparation of changing refrigerants, e.g. R-22 to R-410A (mineral oil to POE oil) as well as to flush the contaminants from a system after a compressor burn out. Typically, due to the high acidic level of contamination in a burn out, more solvent will be required in system flushes than in line set flushes. The 16 oz. can of Pro-Flush solvent, which is enough for every 5-8 tons of system capacity. The Pro-Flush™ Solvent conforms to the EPA Significant New Alternatives Program (SNAP) and is non-ozone depleting and low-toxicity.

Figure 2:
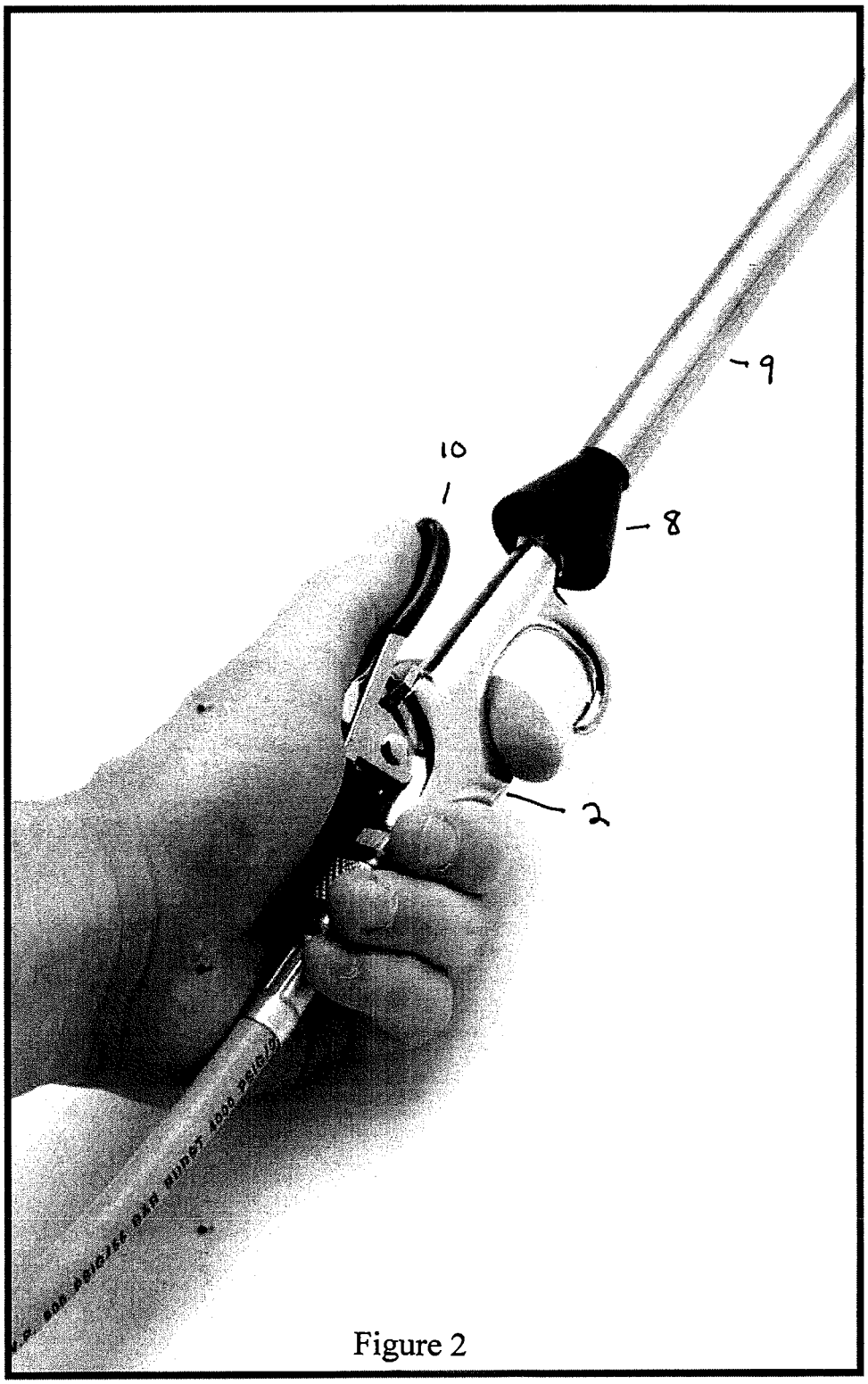
FIG. 2 is a photograph showing the positioning of the injector tool (2) and rubber adaptor (8) in relation to the inlet port (9).

A kit can be tailored to a specific use or adapted on site, by adding or removing components from those shown in the FIG. 1, depending on need. A sealable container to hold contaminated flush material can be included, as can a nitrogen tank (5) with regulator and a vacuum pump (not shown) with accessories.

Further objects, features and advantages will become apparent upon consideration of the following detailed description of the invention when taken in conjunction with the drawings and the appended claims.

The invention claimed is:

1. A flushing solvent comprising,
1-40% hydrofluoroether,
1-40% acetone,
1-40% t-butyl acetate and
20-70% trans 1,2 dichloroethylene.

2. The flushing solvent of claim 1 containing,
18% hydrofluoroether,
10% acetone,
22% t-butyl acetate and
50% trans 1,2 dichloroethylene.

3. The flushing solvent of claim 1 wherein the hydrofluoroether is ethoxy-nonafluorobutane.

4. The flushing solvent of claim 3 wherein the ethoxy-nonafluorobutane is selected from ethyl nonafluorobutyl ether, nonafluoroisobutyl ether or mixtures thereof.

5. The flushing solvent of claim 4 containing,
10-20% ethyl nonafluorobutyl ether,
10-20% ethyl nonafluoroisobutyl ether,
10-20% acetone,
20-30% t-butyl acetate, and
50-60% trans 1,2 dichloroethylene.

6. A kit comprising the flushing solvent of claim 1 in a container.

7. The kit of claim 6 further comprising
charging hose,
clip-on funnel,
injector trigger nozzle, and
reusable tank.

8. The kit of claim 7, wherein the reusable tank has a pressure relief valve.

9. A method for flushing an HVAC-R compressor system having an inlet and a discharge comprising,
a) introduce the solvent of claim 1 into the inlet,
b) purge the solvent,
c) check the solvent exiting the outlet for the presence of contaminants, and
d) repeat steps a)-c) if contamination is present.

10. The method of claim 9 wherein step c) involves a visual inspection and steps a)-c) are repeated if the exiting solvent from the outlet is not clear.

* * * * *